US006386999B2

(12) United States Patent
White

(10) Patent No.: US 6,386,999 B2
(45) **Date of Patent: *May 14, 2002**

(54) METHOD OF USING A FORMING GRID WITH A FIELDING PRACTICE BAT

(76) Inventor: Craig C. White, 1141 Avalon Rd., Fairmont, WV (US) 26554

( * ) Notice: Subject to any disclaimer, the term of this patent is extended or adjusted under 35 U.S.C. 154(b) by 0 days.

This patent is subject to a terminal disclaimer.

(21) Appl. No.: 09/825,550

(22) Filed: Apr. 2, 2001

Related U.S. Application Data

(62) Division of application No. 09/347,713, filed on Jul. 3, 1999, now Pat. No. 6,234,922

(60) Provisional application No. 60/091,789, filed on Jul. 6, 1998.

(51) Int. Cl.[7] ..... A63B 51/02

(52) U.S. Cl. ..... 473/543; 473/457

(58) Field of Search ..... 473/415, 422, 473/510–515, 463, 451, 457, 524, 543, 553, 564

(56) References Cited

U.S. PATENT DOCUMENTS

| | | | | | |
|---|---|---|---|---|---|
| 1,682,199 | A | * | 5/1928 | Smilie | 473/543 |
| 3,048,399 | A | * | 8/1962 | Breitbach | 473/543 |
| 3,834,699 | A | * | 9/1974 | Pass | 473/543 |
| 3,921,979 | A | * | 11/1975 | Dischinger | 473/543 |
| 4,238,262 | A | * | 12/1980 | Fishel | 156/166 |
| 4,399,993 | A | * | 8/1983 | Melin | 473/573 |
| 4,408,760 | A | * | 10/1983 | Ferrari | 473/543 |
| 4,844,478 | A | * | 7/1989 | Kessler | 473/474 |
| 4,880,234 | A | * | 11/1989 | Salisbury | 473/457 |
| 5,143,370 | A | * | 9/1992 | Richards | 473/457 |
| 5,158,285 | A | * | 10/1992 | Flam | 473/543 |
| 5,303,918 | A | * | 4/1994 | Liu | 473/537 |
| 5,570,883 | A | * | 11/1996 | Csabai | 473/543 |
| 5,620,179 | A | * | 4/1997 | MacKay, Jr. | 473/564 |
| 5,993,337 | A | * | 11/1999 | Janes et al. | 473/539 |
| 6,234,922 | B1 | * | 5/2001 | White | 473/543 |

* cited by examiner

*Primary Examiner*—Raleigh W. Chiu
(74) *Attorney, Agent, or Firm*—Steptoe & Johnson PLLC

(57) ABSTRACT

A fielding practice bat is disclosed having a frame, preferably U-shaped, integrally connecting a head portion and a handle portion, wherein the fielding practice bat has a length, weight and balance equivalent to a conventional baseball bat. The head portion is generally tear-drop in shape and has a width no greater than 12 inches. In addition, the head portion is interwoven with a plurality of main strands of elastic tubing and a plurality of cross strands of elastic tubing. In the preferred embodiment, a single piece of elastic tubing comprises the main strands and cross stands of elastic tubing wherein the piece of elastic tubing is woven through holes in the frame. A forming grid is also disclosed comprising a matrix of cells. The forming grid is used with the fielding practice bat by stringing the head portion of the fielding practice bat with one or more first strands, laying the forming grid over the one or more first strands, and weaving one or more second strands through the forming grid thereby securing the forming grid to the head surface of the fielding practice bat. The main and cross strands of the fielding practice bat are interwoven through the cells of the forming grid such that each cell contains a single intersection between a main strand and a cross strand, thereby dampening the vibration of the strands upon contact with the ball.

18 Claims, 17 Drawing Sheets

108

1000

1000

1000

METHOD OF USING A FORMING GRID WITH A FIELDING PRACTICE BAT

CROSS-REFERENCE TO RELATED APPLICATIONS

This application claims the benefit of application Ser. No. 60/091,789, filed Jul. 6, 1998 and is a division of application No. 09/347,713, filed Jul. 3, 1999 now U.S. Pat. No. 6,234,922.

BACKGROUND OF THE INVENTION

1. Field of the Invention

This invention relates to baseball bats and rackets, and more specifically to an apparatus that combines the overall shape and features of a baseball bat with a racket-type head strong with elastic tubing.

2. Related Art

This invention has its roots in baseball. The beginnings of this game originate in Nineteenth Century America as a variation of the many games that made use of some type of bat and ball. It has a long history associated with it, developing from an amateur sport into one that is professional, where spectators pay to watch highly skilled athletes play what is now know as "America's Pastime."

The game of baseball has traditionally been a sport that requires strength and accuracy of the batter to hit thrown balls far away from any opponent. The underlying strategy and primary tactic of this game is to score more points than the opposing team, often by hitting home runs (a phenomenon by which the hitter strikes the thrown ball with a held bat and projects it outside the bounds of the playing field). The problem in achieving home runs with a baseball bat, however, is that the skill level needed to accurately hit and place the ball and the strength required to project the ball a far distance must both be high.

Conventional baseball bats have a narrow head and thin handle, and when the hitter is attempting to hit the ball, little room for error exists when trying to connect bat to ball. The hitter's hand-eye coordination must be high to accurately hit the ball because the narrow size of the head means that possibility of connecting bat to ball is less. Repeated failures when trying to hit the ball with such a bat often leaves the player frustrated. Thus, without the requisite skill needed to accurately hit and place the ball, the batter often connects inadequately or misses completely, and without the opportunity to practice, the player often "gives up," frequently not returning to practice which is necessary to achieve the desired skill.

Such frustration is felt the most with special needs players. There are many different types of players that have special needs, ranging from the very young to the very old and to the physically and mentally handicapped. An important application of special needs players are the various team competitions during the Special Olympics wherein handicapped players compete in baseball, softball and other related sporting events. These players often have difficulty in handling a conventional baseball or softball bat, and in many instances the players are unable to hit a ball with any success or without assistance.

Therefore, there is a need for a baseball-type apparatus that facilitates the playing of bat and ball sports wherein special needs players can play unassisted and achieve immediate success with hitting and placing a ball.

Additionally, because of the thin handle on a traditional baseball bat, the batter's upper body strength and hand strength must both be great in order to swing the bat effectively to hit the ball a far distance. Without the requisite strength needed to forcefully hit the ball, the player often grounds the ball or hits pop-flies. Both of these types of hits makes it easier for an opponent to intercept the ball and throw the hitter out. Traditionally, a deep fly or home-run is what the hitter seeks to achieve, and historically it was the invention of wooden bats that assisted the hitter in obtaining this goal. The theory behind this being that a heavy bat combined with a strong swing would propel the ball far and high into the air. Unfortunately, though, this discouraged many classes of people outside the stereotyped strong, athletic male from playing the sport because the need for such strength in handling the wooden bat was so great.

From this sport of baseball, derivative ball games, such as softball, stick-ball, tee-ball and wiffle-ball, have emerged in America's culture. Each of these variations developed to fulfill particular needs and desires of the American public, each with their own requirements and constraints. With the advent of these related sports and subsequent experimentation in the design of the baseball bat, two derivative inventions were discovered—the aluminum bat and the plastic bat. Though lighter in weight, which alleviated some of the strength required to effectively swing a bat in traditional baseball, this light weight creates an additional problem for the hitter. May batters lose control of such a bat upon the finish of a powerful swing, and this loss of control often causes injury to both sideline players and other bystanders on the field.

Besides these problems, baseball and its derivative ball games have a limited appeal. Each serves a purpose unto themselves, and generally each variation only fulfills their intended purpose. Baseball is both a professional and amateur game, traditionally associated with strong, youthful men. As a predominately male sport, baseball, specifically, has less appeal, because of the perceived physicality needed to be good at the game. While softball developed to make the game of baseball more appealing to those less strong, those a bit older or younger in years, and those of generally less skill, it still requires a certain amount of skill and strength to play effectively. Stickball, whose bat is basically a thin "broom-handle" type stick, has limited appeal because of the traditional geography on which it is played—the streets of the inner cities. Significantly younger people have been afforded the opportunity to compete in still similar ball games through the developments of tee-ball and wiffle-ball, though these batting games are generally reserved only for that class of person.

Therefore, there is a need for a baseball-type bat that is similar in overall appearance and dimensions of a conventional baseball bat, but is easier for a user to swing and achieve greater distance and accuracy.

Moving away from the sport of baseball and related batting games is the racket game of tennis. Tennis is another sport wherein a racket is used to hit and thereby project a ball away from the player. Unlike baseball, however, the game of tennis requires the ball to be hit and accurately placed within a confined set of boundaries. Therefore, the tennis racket is designed to accurately hit a ball short distances. The oval shaped racket is generally made of wood, aluminum or graphite, while the head-face is usually strung with resilient gut or nylon in an interwoven pattern, and the handle is long and thick because most players prefer one-handed over two-handed swings.

Therefore, there is a need for a racket-type apparatus having a racket head-face that gives a user better control in placing a baseball and provides the means for the user to hit a baseball long distances.

SUMMARY OF THE INVENTION

The fielding practice bat of the present invention solves the problems associated with conventional baseball bats and tennis rackets by combining the best features of both apparatuses. In the preferred embodiment, the fielding practice bat comprises a frame having the same general shape, weight and balance of a conventional baseball bat wherein one end of the frame is a handle portion and the other end is a head portion that forms a head surface for hitting a ball. The head portion is similar in design to conventional tennis rackets in that it is interwoven with strands to form a head face. However, in contrast to conventional rackets, the fielding practice bat of the present invention has a head portion that has a very slender tear-drop shape, which preferably is about twice the width of a conventional baseball bat, and is woven with elastic tubing. The use of elastic tubing, as opposed to elastic straps or string, is novel and is not currently available in any known racket design.

There are several advantages with the design and shape of the fielding practice bat of the present invention. First, because the fielding practice apparatus has the same weight and balance of a conventional baseball bat, players of the game will be comfortable and at ease with using the fielding practice bat. Second, the fielding practice bat is designed to work with both baseballs and softballs; therefore, no new balls are needed. Third, the design of the fielding practice bat offers those not particularly skilled in ball sports the advantage of consistency hitting the ball with accuracy.

Furthermore, in the preferred embodiment, the head of the fielding practice bat is strung in an interwoven pattern with elastic tubing. The woven face of the bat diminishes the wind resistance of a conventual bat when swung, and as a result, decreases the chance for sports-related injuries. Also, the woven face of the bat will not only increase the percentage of accurately placed deliveries of the ball, but it also increases the range at which balls can be driven.

Another advantage of the fielding practice bat of the present invention is to make coaching easier. Many coaches are not skilled at hitting a ball with a conventional bat during the course of fielding practice because coaches must repeatedly and consistently hit balls to players in the outfield and infield for practice. This means that a coach must hit many balls time and time again, thereby becoming fatigued which in turn degrades the coach's performance. Once the coach's performance degrades, it has a direct impact on the quality of practice received by the fielder.

The fielding practice bat of the present invention allows balls to be accurately placed with the desired force after only a few attempts and with minimal effort. This will aid coaches in working with players on their fielding techniques. For example, most Special Olympics and Little League coaches are volunteers and could use the fielding practice bat to repeatedly hit the ball into the field for fielding practice without become overly tired and without the usual skilled required.

Additionally, the fielding practice bat is designed for those with little skill who simply want to join in a baseball or softball game for fun and recreation. During the summer months, family or class reunions are a popular time for softball games. The fielding practicing bat will allow individuals who are reluctant to participate in baseball and related games due to a lack of skill to participate and achieve accurate and long hits. Furthermore, the fielding practice bat may be used by disabled or elderly individuals to participate in the related sports. It will also decrease the risk of shoulder or arm injury for the player because the woven face of the bat decreases wind resistance.

Another object of the present invention is to provide means for players not particularly skilled in the sport the ability to achieve a better natural form without special training.

A further object of the present invention is to provide a bat comparable to a regulation bat which provides greater accuracy in placing balls and increases the distance at which the ball can be driven.

The main objections of the fielding practice bat are to increase accuracy and alleviate the need for strength when hitting and placing a ball in traditional batting games, promoting a sense of achievement and power for which all ball players thrive. With a larger head, which increases the dimensions available to connect it with the ball, the necessary skill required to accurately hit and place the ball reduces. With elastic tubing strung within the head surface (this is used as a substitute for a solid or hollow bat head), it reduces the strength needed to hit balls a great distance. A thicker handle increases stability when swinging and durability of the invention itself, while at the same time, it also reduces the strength of grip required to effectively swing the bat.

Additional objects, purposes and advantages of the invention will be apparent to those skilled in the art in view of the following description of preferred embodiments of the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
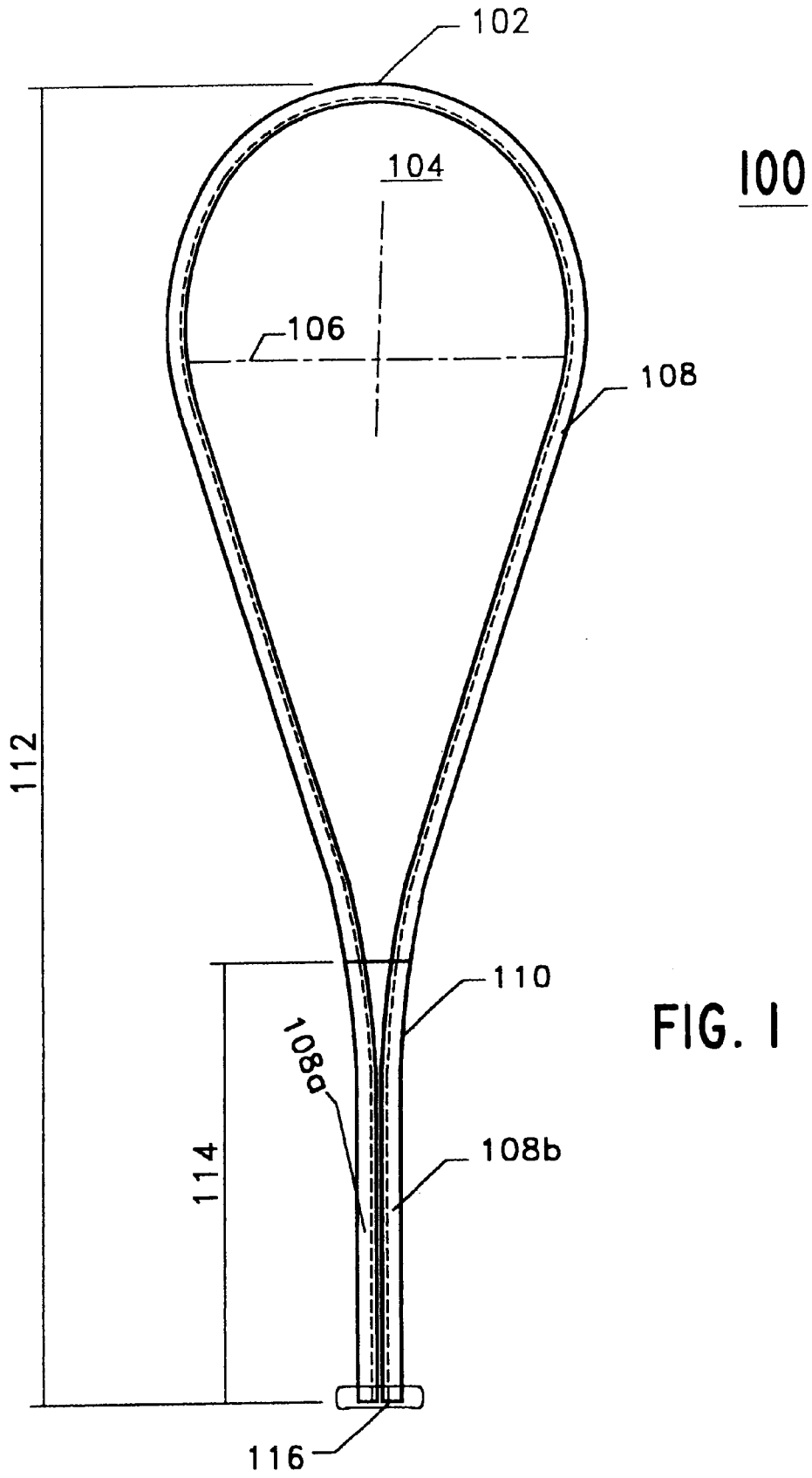
FIG. 1 is a planar front view of a fielding practice bat of the present invention.
Figure 2A:
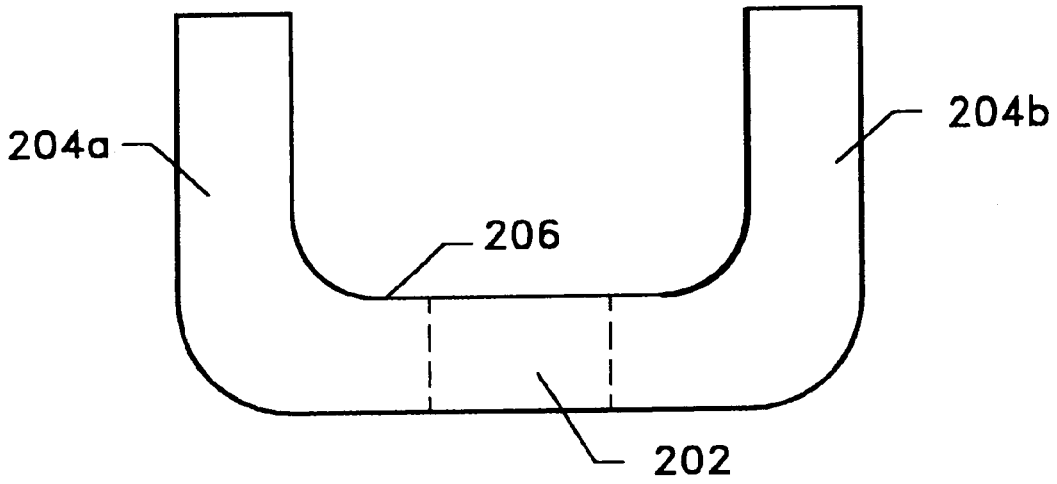
FIG. 2A is a cross-sectional view of a frame of the fielding practice bat.
Figure 2B:
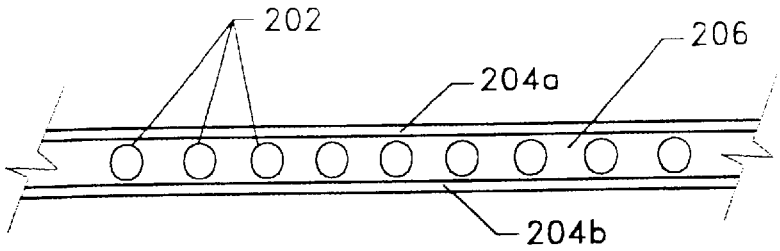
FIG. 2B is a planar top view of the frame.
Figure 2C:
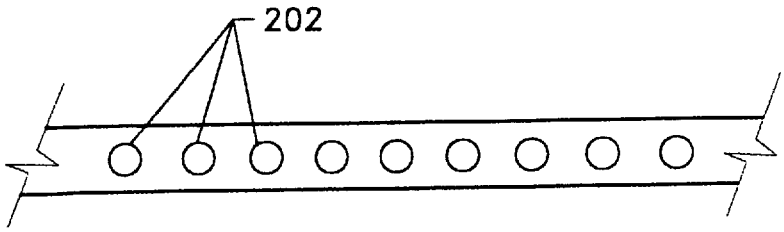
FIG. 2C is a planar bottom view of the frame.
Figure 2D:
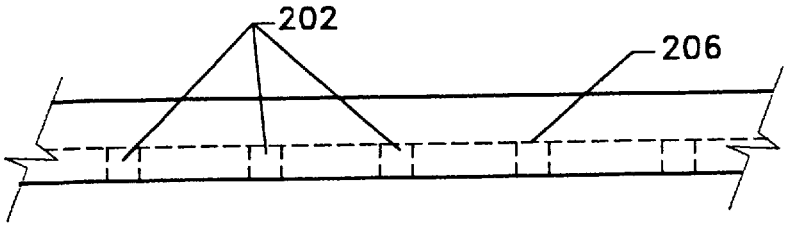
FIG. 2D is a planar side view of the frame.
Figure 2E:
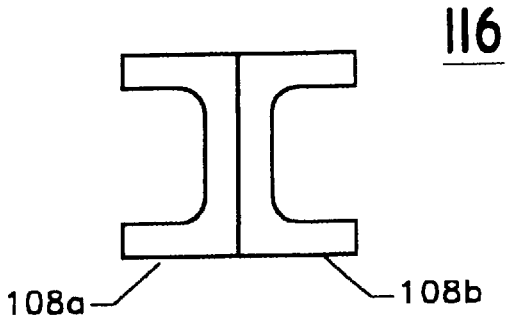
FIG. 2E is a planar view of the bottom of the handle portion of the fielding practice bat.

The fielding practice bat (or "bat") of the present invention comprises a racket-like frame that has the overall appearance, size, weight and balance of a conventional baseball or softball bat. FIGS. 1–2E illustrate the frame 108 of a fielding practice bat (the "bat") 100 of the present invention having a head portion 102 and a handle portion 110 that are integrally connected via a single frame 108. The head portion 102 of the frame 108, as described below, is threaded with elastic tubing, thereby creating a head surface 104 with which a user hits a ball. In the preferred embodiment, the frame 108 is a single piece of extruded aluminum that is bent into the preferred tear-drop shape wherein the two ends 108*a,b* of the frame 108 come together at the handle portion 110, terminating at the handle portion end 116. The fielding practice bat 100 may be designed and manufactured according to any range of dimensions; however, the following dimensions are the preferred specifications: a length 112 of 25–34 inches (with a preferred length 112 of 32 inches), a head width 106 of 9–12 inches (with a preferred head width 106 of 10–11 inches which can handle both baseball and softball), a handle portion length 114 of 7–9 inches (with a preferred handle portion length 114 of 8.5 inches), a throat piece 302, described below, positioned 11–15 inches from the top of the head portion 102, and a weight of about 18–36 ounces.

The actual dimensions used are scaled according to the target user. For example, in designing and manufacturing a junior-sized fielding practice bat for children, the dimensions may be: a length 112 of 26–28 inches and a weight of about 18–19 ounces, wherein the remaining dimensions remain about the same, whereas an adult-sized fielding practice bat 100 may be 32 inches in length 112 and have a weight of about 32 ounces. The use of these dimensions are for convenience purpose only. It would be readily apparent to one of ordinary skill in the relevant art(s) to use different dimensions.

The frame 108 may be solid or composed of a tubular extrusion (e.g., a D-channel) of any appropriate material, e.g., aluminum, composites, wood, or a combination thereof. However, the frame 108 in the preferred embodiment is U-shaped, or U-channeled, aluminum which protects the elastic tubing threaded through the frame 108, makes the bat 100 more lightweight compared to a solid frame or tubular extrusion, and facilitates both the creation of a hand-grip on the handle portion 110 and the re-stringing of the head surface 104 of the bat 100.

As illustrated by FIGS. 2A–E, this U-shaped frame 108 is created by two rims 204*a,b* on the outside of the frame 108. In the preferred embodiment, each rim 204*a, b* being one-eighth (⅛) of an inch wide and one-fourth (¼) of an inch high, creating a recessed bottom 206 one-fourth (¼) inches wide and three-sixteenths (3⁄16) inches high. The recessed bottom 206 contains a plurality of uniformly spaced holes 202. In the preferred embodiment, the holes 202 are three-fourths (¾) of an inch apart on center and three-eights (⅜) inches in diameter. Additionally, the bottom inside and outside corners of the frame 108 (where the rims 204*a,b* join the recessed bottom 206), may be rounded or square. Rounded corners are preferred because this would prevent scoring of a ball when a player's swing is off and the ball hits the frame 108 of the bat 100 rather than the tubing of the head surface 104. FIG. 2E shows the handle portion end 116 of the fielding practice bat 100 where the two ends 108*a,b* of the frame 108 come together. For convenience purpose only, the two ends of the frame 108 are shown as a first frame end 108*a* and a second frame end 108*b*.

Figure 3A:
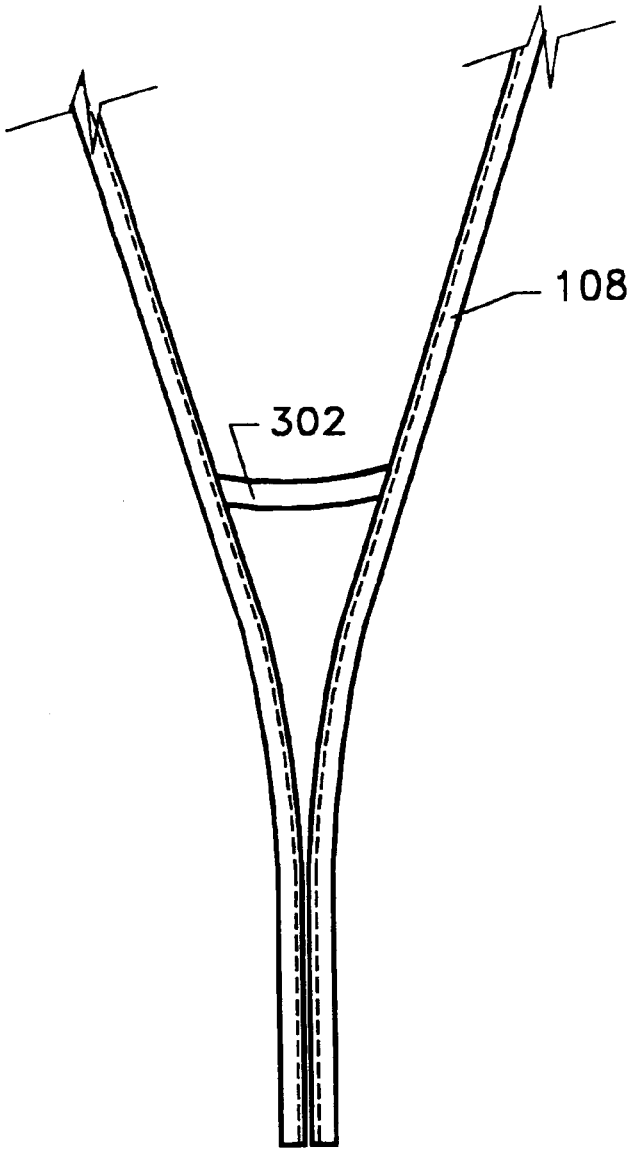
FIG. 3A is a planar front view of the fielding practice bat showing a throat piece.
Figure 3B:
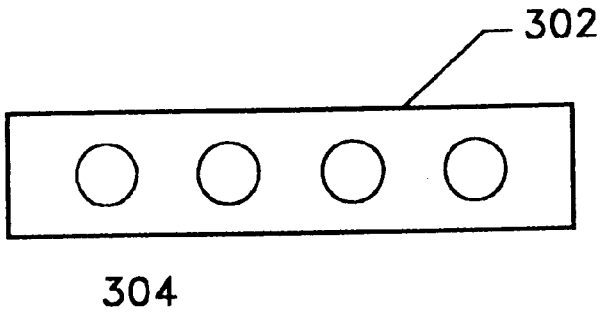
FIG. 3B is a planar top view of the throat piece.

FIG. 3A illustrates a bat 100 having a throat piece 302 inserted into the frame 108. A throat piece 302 stabilizes the operation of the bat 100 by dampening vibration, making it easier to re-string, and reducing the amount of elastic tubing required to re-string the bat 100. FIG. 3B provides a planar top view of the throat piece 302, showing the holes 304 drilled therein. The number of holes 304 and their placement on the throat piece 302 are for convenience purposes only, but preferably there are four (4) holes 304 in the throat piece 302 wherein their size is the same as the holes 202 in the frame 108 and their position in the throat piece 302 is such that they are aligned with the opposing holes 202 in the frame 108. However, it would be readily apparent to one of ordinary skill in the relevant arts to use a different number and placement of holes 304.

Figure 4:
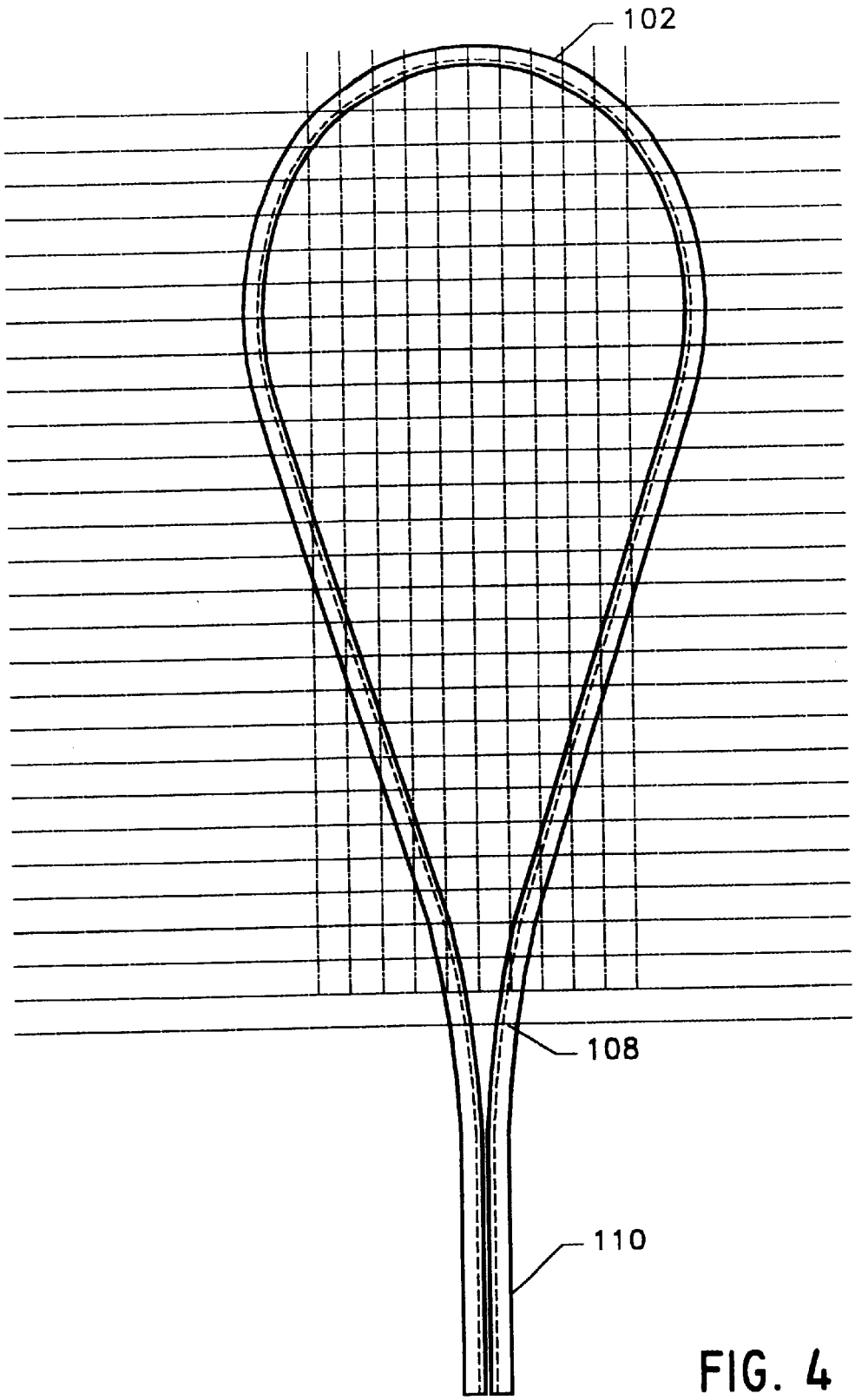
FIG. 4 is planar front view of the fielding practice bat showing the placement of holes in the frame.

FIG. 4 provides a planar view of the bat 100 showing the placement of holes 202 in the frame 108. However, the placement and number of holes 202 in the frame 108 is for convenience purposes only. It would be readily apparent to one of ordinary skill in the relevant arts to use a different number and placement of holes 202 in order to achieve varying results. For example, if the holes 202 are placed far apart, a player would have to swing the bat 100 harder to reach far distances and the player would gain a certain amount of control for placing a ball. If the holes 202 are spaced close together, the head surface 104 is tightly woven and with little effort would be able to hit a ball farther but would lose some control for placing the ball. In addition, if the holes 202 are so close together that the tubing is side-by-side without spaces in-between, there may be no use of a forming grid, as described in detail below.

Figure 5:
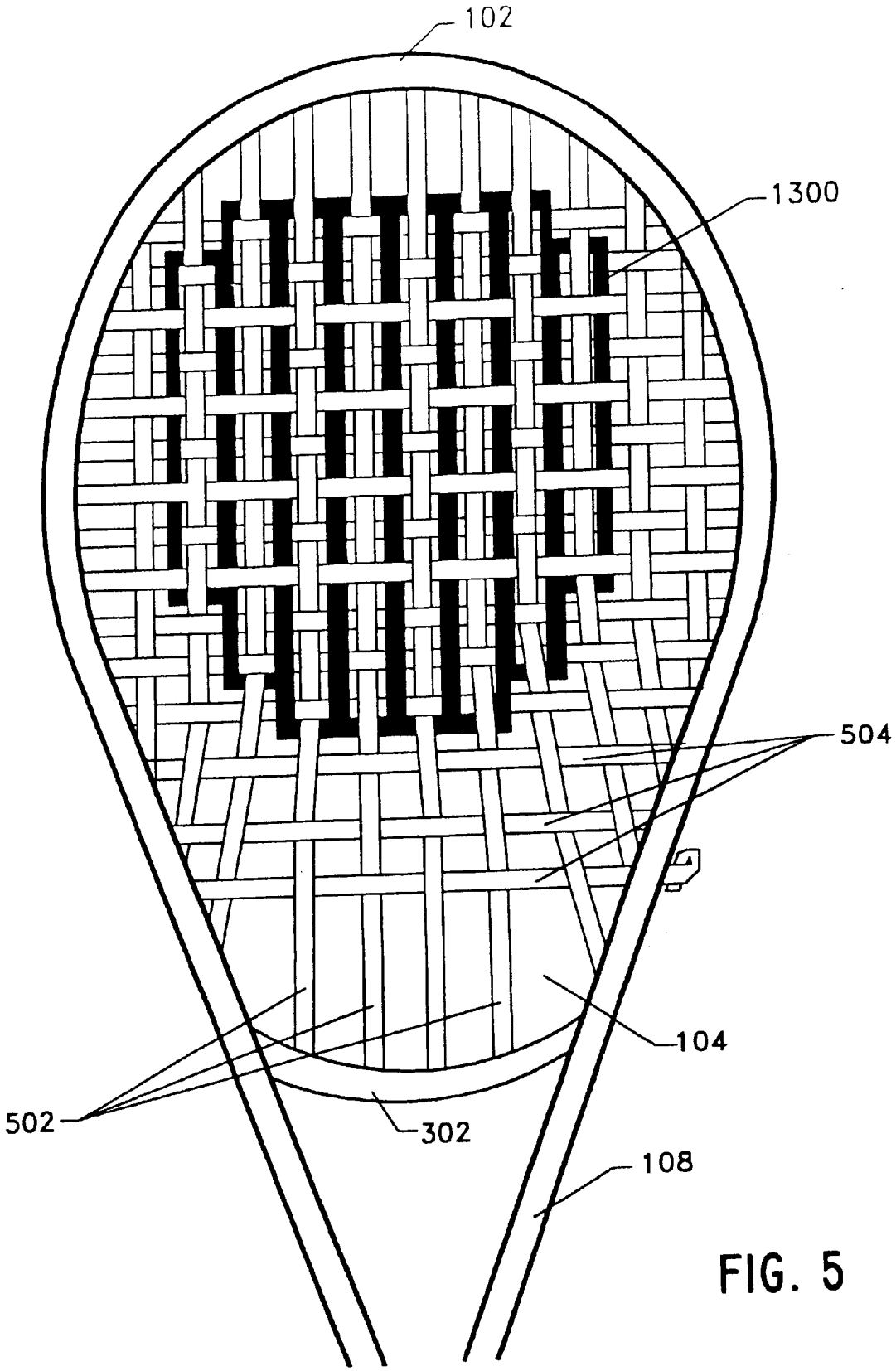
FIG. 5 is a perspective view of a fielding practice bat incorporating main and cross elastic strands of tubing.

FIG. 5 is a perspective drawing of the head portion 102 of the fielding practice bat 100 of the present invention showing the complete bat 100 including the frame 108 and throat piece 302 being interwoven with main strands 502 and cross strands 504 of elastic tubing. In the preferred embodiment, commercially available natural latex rubber tubing is threaded through the holes 202 of the frame 108 of the bat 100 and through the holes 304 of the throat piece 302. For convenience purpose only, the main strands 502 are the portions of elastic tubing extending vertically, i.e., extending from the top of the head portion 102 to the throat piece 302, and the cross strands 504 are the portions of elastic tubing extending horizontally, i.e., extending side-to-side across the head surface 104. In the preferred embodiment, a single piece of tubing approximately twenty-five (25) feet long, having a wall thickness within the range of about 1/32 of an inch to about 1/8 of an inch, an inner diameter within the range of about 1/16 of an inch to about 1/4 of an inch, and an outer diameter within the range of about 3/16 of an inch to about 5/16 of an inch, is used to thread the head surface 104 of the bat 100. Specifically, the preferred embodiment uses an elastic tubing having a wall thickness of 3/32 of an inch and an outer diameter of 5/16 of an inch. The above described ranges of elastic tubing sizes provide the best strength, durability, and overall results. However, elastic tubing having a different wall thickness, inner diameter, and outer diameter could be used without departing from the scope of this invention.

In an alternative embodiment, a plurality of tubing pieces could be used to thread the head surface 104 of the bat 100. For example, a first piece of elastic tubing may comprise all of the main strands 502 and a second piece of elastic tubing may comprise all of the cross strands 504. Additionally, the elastic tubing could be one or more colors. Therefore, depending on the number of pieces of elastic tubing used to weave the head surface 104, it would be readily apparent to one of ordinary skill in the relevant art(s) to create a pattern, design or picture using colored elastic tubing.

The threading or weaving of the elastic tubing results in a matrix of strands where two perpendicular sods cross at an intersection. When threading the head surface 104 of the bat 100 with the elastic tubing, the user should pull the tubing approximately one (1) inch before threading the tubing through the next hole 202. This one (1) inch approximation should provide the proper amount of tension on the strands. However, this approximation is for convenience purposes only. It would be readily apparent to one of ordinary skill in the relevant arts that different tensions would achieve different performance results.

There are many different patterns one may use when weaving the elastic tubing. In one embodiment, the main strands 502 and the cross strands 504 are woven in a conventional over-under pattern. That is, each main strand 502 and cross strand 504 alternates between going over, then going under, the next strand in sequence. In the preferred embodiment, however, a forming grid is used, which is described in greater detail below, wherein the main strands 502 and the cross strands 504 are not interwoven. That is, all main strands 502 remain on the same side of the cross strands 504, and all cross strands 504 remain on the same side of the main strands 502. This configuration of main strands 502 and cross strands 504 is shown and described in greater detail below.

To protect the tubing passing through the holes 202 of the bat 100, a grommet made of plastic, latex, metal, or similar material may be inserted into each hole 202. A grommet will protect the tubing from rubbing against the edge of a hole 202 and getting cut. Alternatively, each hole 202 can be sprayed with a polyurethane coating (or any similar compound used for smoothing rough edges), thereby providing a smoother surface for the tubing such that the tubing does not wear or get cut on the edge of a hole 202.

Figure 6:
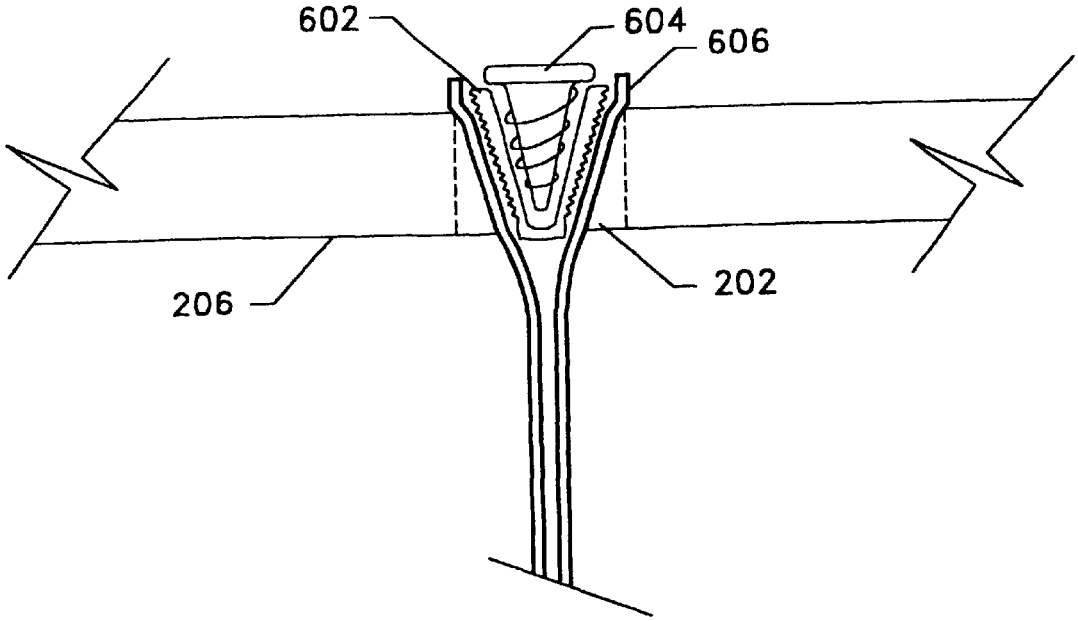
FIG. 6 is a planar side view of the frame showing a means for securing a piece of elastic tubing in a hole of the frame.
Figure 7:
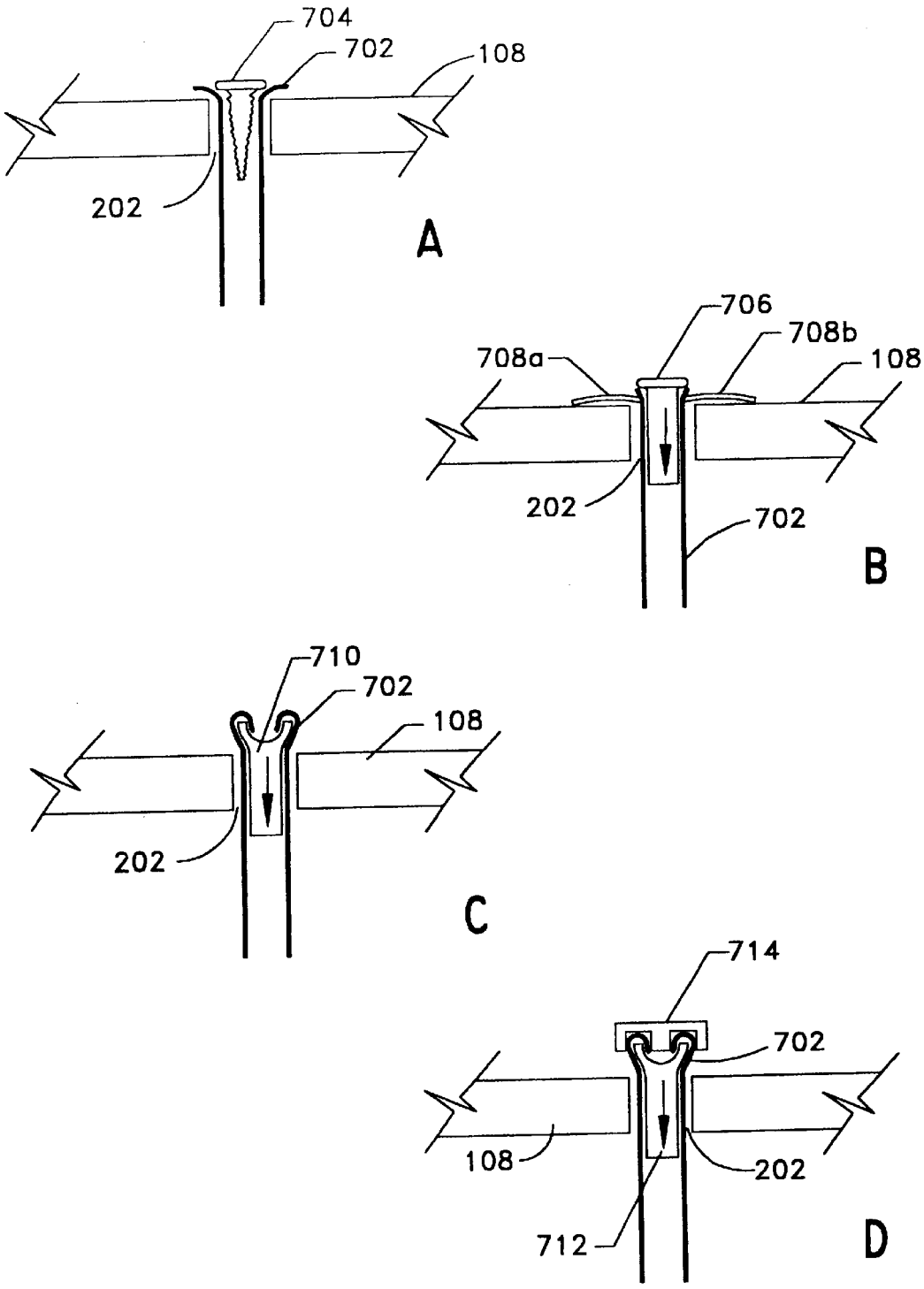
FIG. 7A is a planar side view of the frame showing the use of a sawtooth fastener for securing a piece of elastic tubing in a hole of the frame.
FIG. 7B is a planar side view of the frame showing the use of a pin with locking flange for securing a piece of elastic tubing in a hole of the frame.
FIG. 7C is a planar side view of the frame showing the use of a golf-tee pin for securing a piece of elastic tubing in a hole of the frame.
FIG. 7D is a planar side view of the frame showing the use of a pin with a cap for securing a piece of elastic tubing in a hole of the frame.

In the process of threading the head space 104 of the bat 100 with the tubing, it is necessary to connect each piece of elastic tubing, used in making the head surface 104, to the frame 108 of the bat 100. FIG. 6 illustrates the preferred manner in which an end of a piece of elastic tubing 606 may be "tied off." The elastic tubing 606 is threaded through a hole 202, a screw sheath 602 is inserted into the tubing 606 passing through the hole 202 of the frame 108. The screw sheath 602 is of the type commercially available and has a plurality of ridges positioned on its external side. Once the screw sheath 602 is properly positioned, a screw 604 is then threaded into the screw sheath 602. The action of turning the screw 604 in the screw sheath 602 causes the sheath 602 to expand and the plurality of ridges to bend, from a retracted position in an outward fashion thereby engaging and locking the elastic tubing 606 into the hole 202 so that the tubing 606 cannot be pulled out. The extra tubing 606 extending beyond the hole 202 of the frame 108 is then cut off at a reasonable length so as not to interfere with the operation of the bat 100.

Similarly, FIGS. 7A–D illustrate other possible means of securing an end of a piece of tubing 702 in a hole 202 of the frame 108 of the bat 100. These methods include a saw tooth fastener 704, FIG. 7A, a combination of pin 706 and locking flanges 708*a,b,* FIG. 7B, a "golf tee" pin 710, FIG. 7C, and a pin 712 with a locking cap 714, FIG. 7D. All of these different means for securing apiece of tubing 702 in a hole 202 of the frame 108 are commercially available and are used for convenience purpose only. It would be readily apparent for one of ordinary skill in the relevant art(s) to use these or other comparable means without departing from the scope of this invention. In addition, another means not shown is the very conventional method of "tying a knot" at the end of the piece of tubing to prevent the tubing from retracting back through the hole 202. Regardless of the means chosen for securing a piece of elastic tubing in a hole 202 of the frame 108, in the preferred embodiment, the "channel" feature of the frame 108 will protect the secured ends of the tubing, as well as, the tubing as it is woven between adjacent holes 202.

Figure 8:
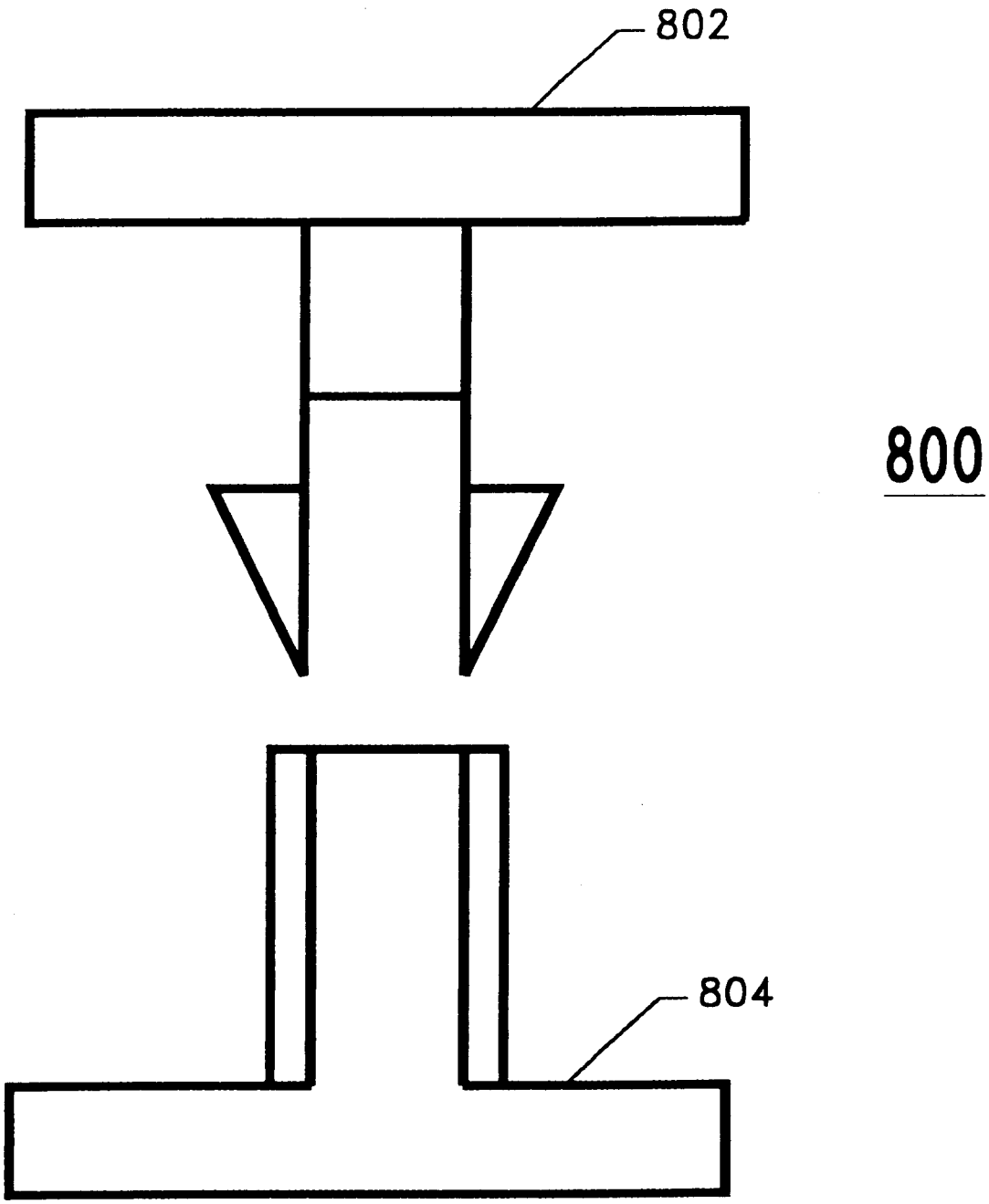
FIG. 8 is a planar view of a top half and bottom half of an interlocking connector used to secure an intersection of a cross strand and a vertical strand.

Securing intersecting strands of tubing decreases vibration of the bat 100 and increases both stability of the bat 100 and accuracy of ball placement with the bat 100. FIG. 8 illustrates a means of securing overlapping or intersecting strands of tubing so that the strands of tubing do not separate. In this embodiment, a bottom portion 804 and a top portion 802 are used wherein the top portion 802 interlocks with the bottom portion 804 when the two portions are pressed together. In operation, a user places a bottom portion 804 behind a point (the intersection) at which a main strand 502 crosses a cross strand 504 in the head surface 104 of the bat 100. The user then pushes a top portion 802 through the point of intersection until it locks into the bottom portion 804. This prevents separation of the main strand 502 from the cross strand 504. In other embodiments, the intersections can be glued (e.g. Perma-Bond or Crazy Glue) or stitched (e.g. nylon stitching) so that the crossing strands do not separate. The securing of the intersections between main stands 502 and cross strands 504 is described in these terms for convenience purpose only. It would be readily apparent to one of ordinary skill in the relevant art to use a comparable means for securing such intersections.

Figure 9A:
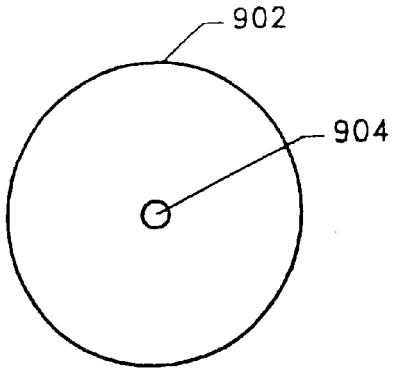
FIG. 9A is a planar top view of a butt cap for covering the bottom of the handle portion.
Figure 9B:
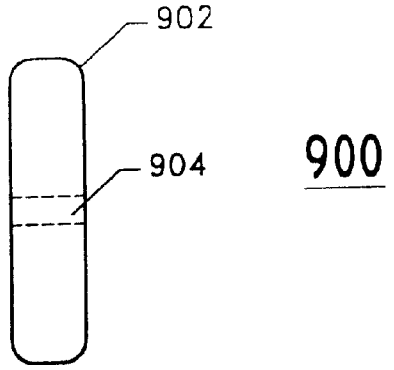
FIG. 9B is a planar side view of the butt cap.

The present invention also comprises a means for securing the frame 108 at the handle portion 110 of the bat 100. One means includes a butt cap 900 as shown in FIGS. 9A, B. In the preferred embodiment, the butt cap 900 is a rounded aluminum disk 902, approximately 2–3 inches in diameter and about ¼ inches thick and has a hole 904 centrally located. The butt cap 900 is centrally positioned over the handle portion end 116 of the frame and a screw is used, passing through the hole 904, to attach the butt cap 900 to the handle portion end 116 of the frame 108. In addition to aiding in holding the frame ends 108*a,b* together, the purpose of a butt cap 900 is very similar to that of the knob on the end of the handle of an aluminum baseball bat: to help prevent the bat 100 from slipping out of the user's hands. Additionally, a butt cap 900 protects the end of the handle portion 114 of the bat 100 and protects the player from getting injured on the possibly rough edges 108*a,b* of the handle portion 114 of the bat 100.

Figure 10A:
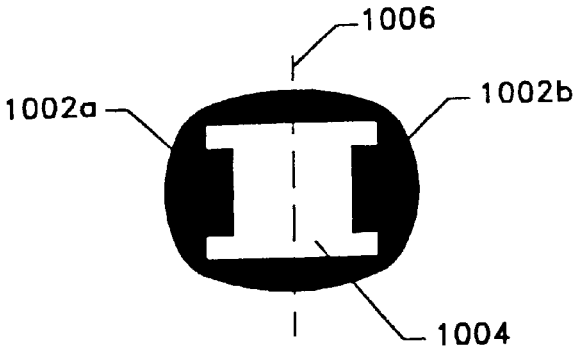
FIG. 10A is a planar end view of a hand grip for the handle portion without the frame.
Figure 10B:
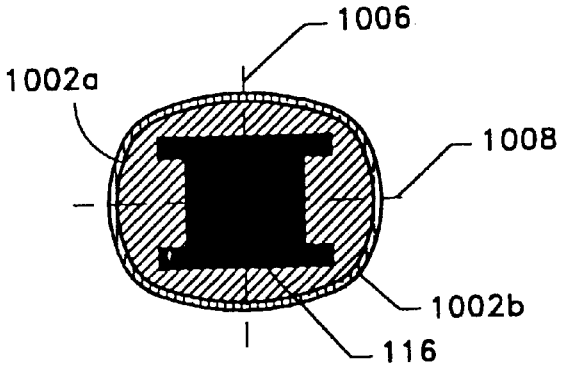
FIG. 10B is a planar end view of the hand grip incorporating the frame.
Figure 10C:
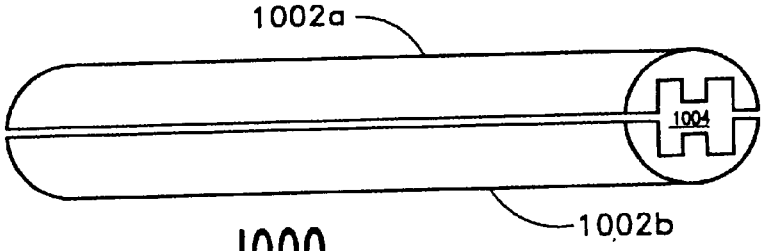
FIG. 10C is a perspective view of the hand grip.

In addition to a butt cap 900, FIGS. 10A–C disclose a hand-grip 1000 that covers the handle portion 110 of the bat 100, thereby making the bat 100 more comfortable in a user's hands. The hand-grip 1000 is the correct size and shape to fit easily within the clasped grip of an average individual and may be wrapped as a handle portion of a conventional bat. In the preferred embodiment, the hand grip 1000 has an oval exterior shape to ensure the proper positioning of the fielding practice bat 100 in a user's hand, i.e., the head surface 104 is facing the proper direction for hitting a ball. Also in the preferred embodiment, the circumference of the hand grip 1000 is in the range of about 4–5 inches, with the preferred circumference being 4.5 inches.

The hand grip 1000 comprises a hand grip frame 1002*a,b* that is preferably split into a first half 1002*a* and a second half 1002*b,* both of which are patterned to match the shape of the frame 108, a U-shape channel. For manufacturing purposes, the hand grip frame 1002 is made in two equal pieces, the first half 1002*a* and the second half 1002*b,* that when positioned around the handle portion 110 of the bat 100 and secured together, the handle portion 110 is complete encapsulated by the hand grip 1000. Further, each half 1002*a, b* may be a solid form for fitting within, or matching, each end 108*a,b* of the frame 108, as shown, or may be hollow wherein the hollow chambers may be filled with a filler material, e.g. rubber, foam, or any comparable cushioning material.

FIG. 10A shows the end of the hand grip 1000 and specifically, the first half 1002*a* and the second half 1002*b* as joined along the seam line 1006. The seam line 1006 is the line at which the first end 108*a* and the second end 108*b* of the frame 108 come together and form the handle portion 110 of the bat 100. FIG. 10B shows the handle portion end 116 enclosed by the two halves 1002*a,b* of the hand grip 1000. FIG. 10C shows a complete hand grip 1000 as used to fully encompass and enclose the handle portion 110 of a fielding practice bat 100 of the present invention. To secure the hand grip 1000 to the handle portion 110, about 2–3 screws are used along the central axis 1008. In the preferred embodiment, the screws are countersunk in the hand grip in a well-known manner in order to protect a user from getting scratched or otherwise caught. The use of screws is for convenience purpose only. It would be readily apparent to one of ordinary skill in the relevant art to use a comparable means, e.g., bolts or an adhesive, to secure the hand grip 1000. In addition, the hand grip 1000 of the present invention may be manufactured and installed by other means, such as making the hand grip 1000 as one integral piece and then sliding the hand grip 1000 onto the handle portion 104 of the bat 100. Furthermore, although the preferred hand grip 1000 is made of aluminum, it could also be manufactured using a different metal, plastic foam rubber, or other composite material.

Figure 11:
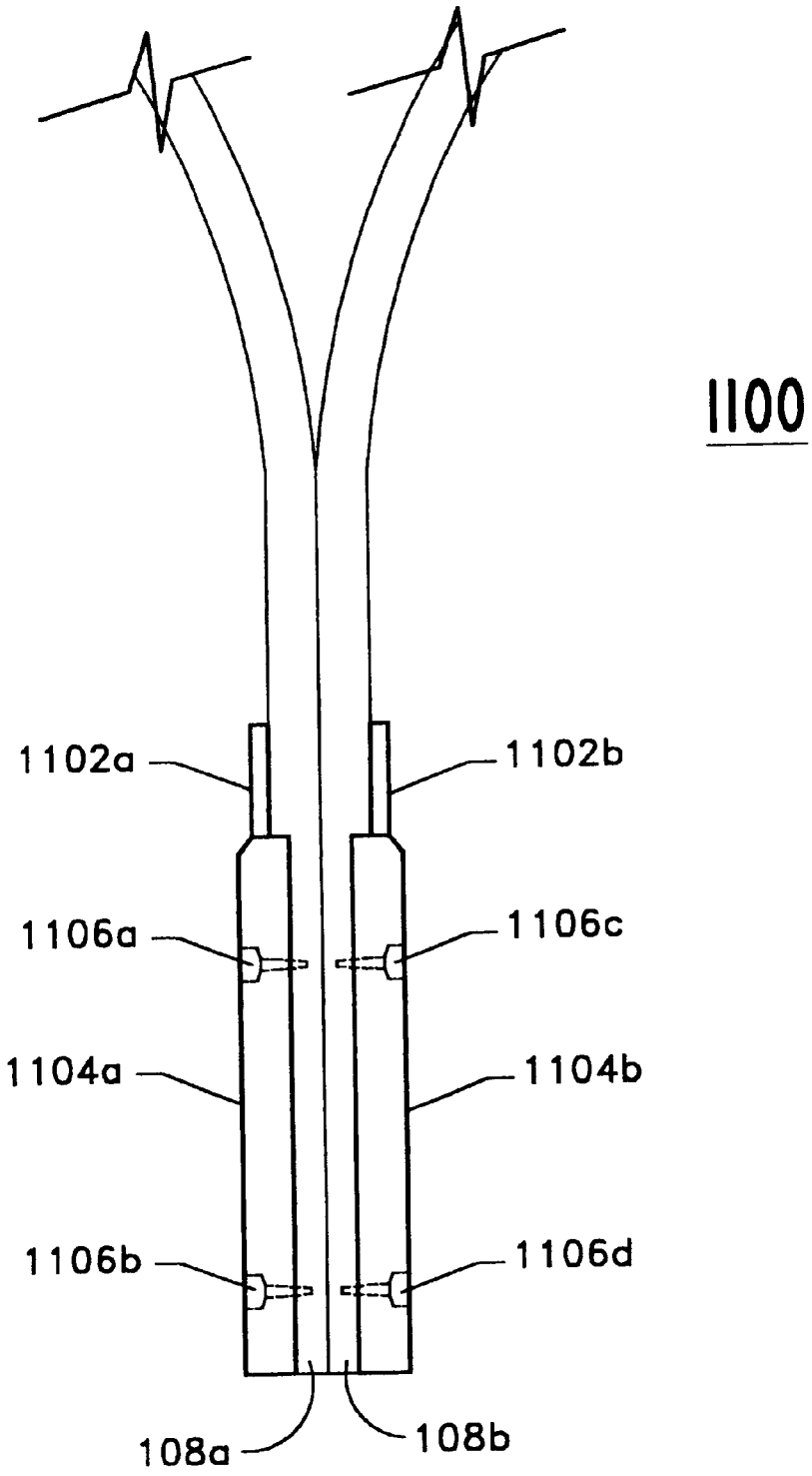
FIG. 11 is an alternative embodiment of a hand grip.

FIG. 11 illustrates an alternative embodiment for a hand-grip 1100. The hand-grip 1100 has two halves, each of which fits within one end 108*a,b* of the frame 108. In the preferred embodiment, the hand-grip 1100 comprises a first rounded portion 1102*a* that is inserted into the first end 108*a* of the frame 108 comprising one half of the handle portion 110 and a second rounded portion 1102*b* that is inserted into the second end 108*b* of the frame 108 comprising the second half of the handle portion 110. These two rounded portions 1102*a,b* are used to smooth out the channeling of the frame 108. Then, a first grip 1104*a* is secured over and encompassing the first rounded portion 1102*a,* and a second grip 1104*b* is secured over and encompassing the second rounded portion 1102*b.* The first and second grips 1104*a,b* can be secured via any appropriate means, such as, with screws 1106*a–d,* as shown, or with an adhesive, bolts, fasteners, and the like. The grip 1104*a,b* portion of this hand grip 1100 is typically made of a comfortable material, such as, foam rubber. If the grip 1104*a,b* happens to wear out, or otherwise is to be replaced, a player can simply remove the old grip 1104*a,b* and attach a new grip 1104*a,b* over the existing rounded portions 1102*a,b.*

Figure 12:
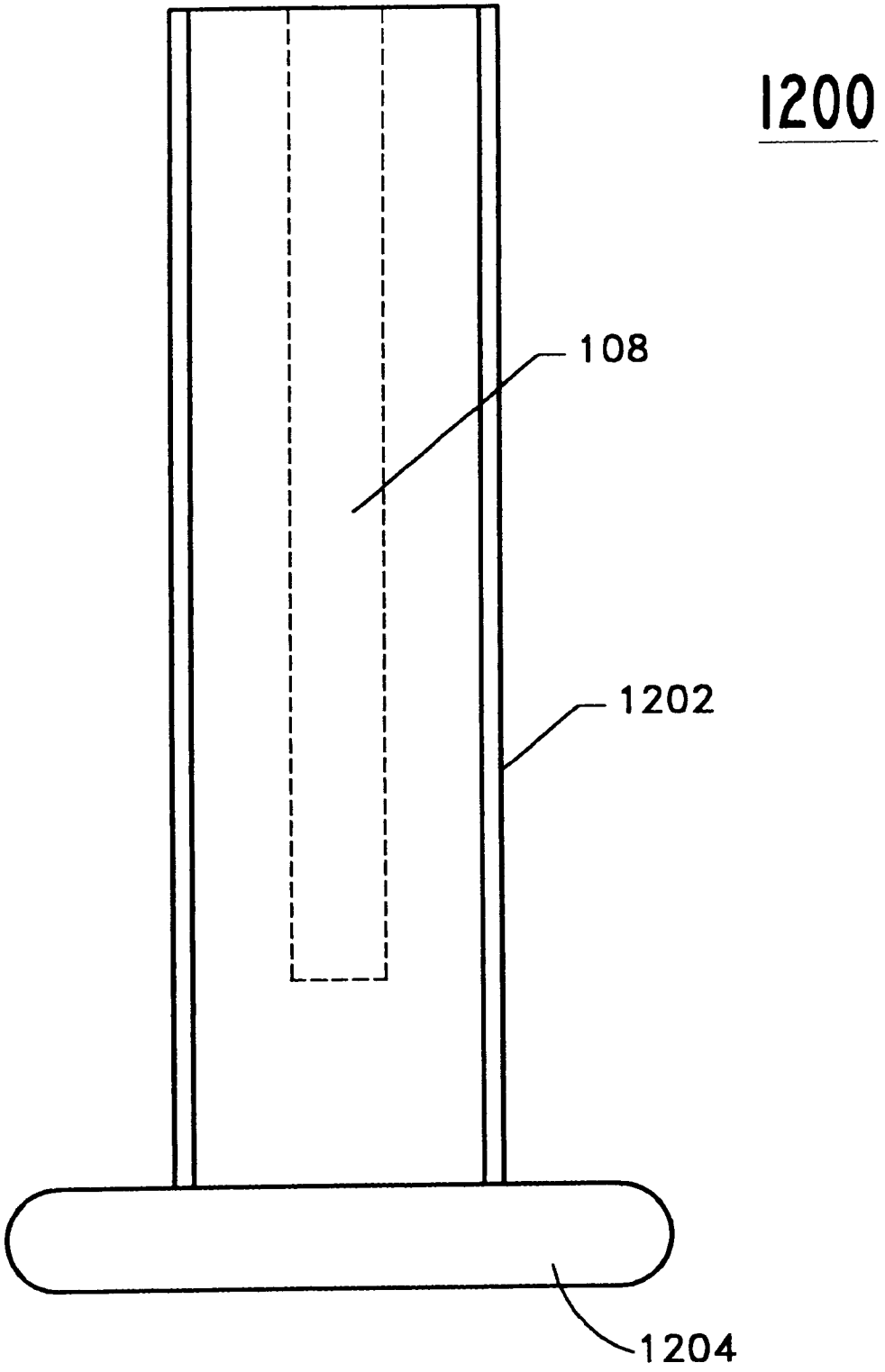
FIG. 12 is an alternative embodiment of a hand grip.

FIG. 12 is another alternative embodiment for a hand grip 1200 which combines a hand grip and a butt cap. In this embodiment, the hand-grip 1200 is a rubber sleeve 1202 that slides, or fits, over the handle portion 114 of the frame 108 of the bat 100 with a knob 1204 on its end that functions similar to that of a butt cap 900. This hand grip 1200 may be made of a composite material, rubber, a durable foam rubber, or the like.

Although only some of the most effective hand grips and butt caps are disclosed herein. These embodiments are described for convenience purpose only. It would be readily apparent to one of the ordinary skill in the relevant art(s) that other hand-grips or butt caps may be used without departing from the scope of this invention. Furthermore, it would be readily apparent for one of ordinary skill in the relevant art(s) to wrap a hand grip with tape as typically done with convention baseball bats.

Figure 13A:
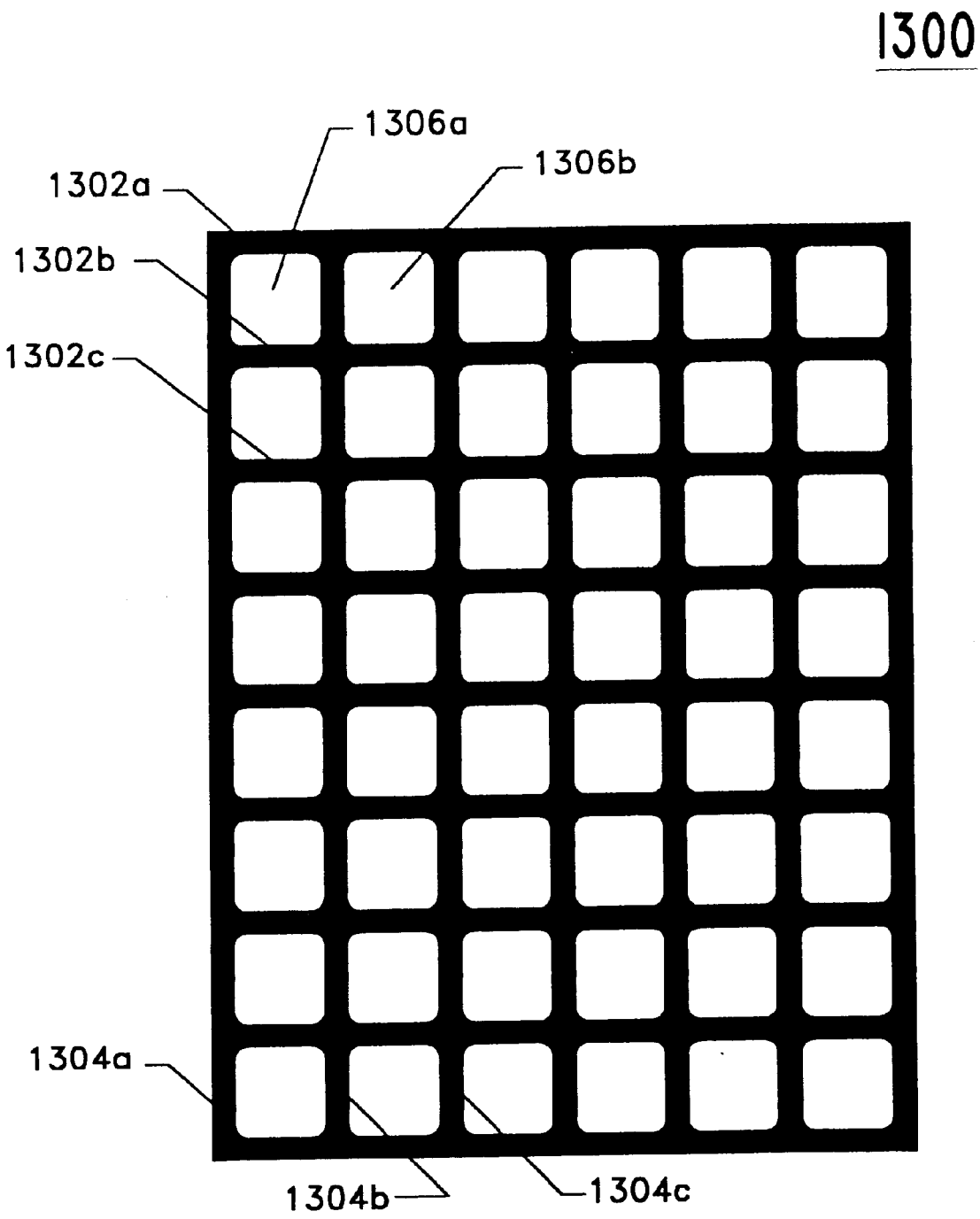
FIG. 13A is a planar view of a preferred embodiment of a forming grid.

Referring to FIG. 13A, a forming grid 1300 is shown which is used to prevent the separation of the intersections of main strands 502 and cross strands 504 of elastic tubing. The forming grid 1300 is a matrix made of hard, yet flexible, material (e.g., solid rubber) and can be any color(s) or any shape. Likewise, the holes or cells 1306 of the forming grid 1300 may be any shape and may be close together or far apart depending on the desired performance of the bat 100.

In the preferred embodiment, the forming grid 1300 is a uniform thickness that may range from about 1/32 to about 1/16 of an inch. However, in an alternative embodiment, the perimeter walls of a forming grid 1300 may be thicker than the interior walls. Furthermore, in the preferred embodiment, the cells 1306 of a forming grid 1300 have rounded interior corners, as shown, with a curved radius of about 3/32 of an inch. Also, each cell 1306 of the forming grid 1300 is square in shape having an outer dimension of about 1×1 inches and an interior dimension of 0.5×0.5 inches. In alternative embodiments, the cell 1306 may have square corners or have a different shape, e.g., round, oval, or tear-drop, wherein the cell 1306 shape is used to enhance the tear resistance of each cell 1306 upon the exertion of force when hitting a ball.

Alternatives to using a forming grid 1300 include weaving pieces of Velcro through the strands such that the Velcro prevents separation of intersecting strands and dampens vibration; spacing the holes 202 closer together on the frame 108 such that the main strands 502 and the cross strands 504 are side-by-side with no spaces between them; or strategically placing a plurality of smaller forming grids in the head surface 104 of a bat 100 such that the combination of the separate forming grids together define one or more protected areas in the head surface 104. In either of these embodiments, the need for a single forming grid 1300 is eliminated.

Figure 13B:
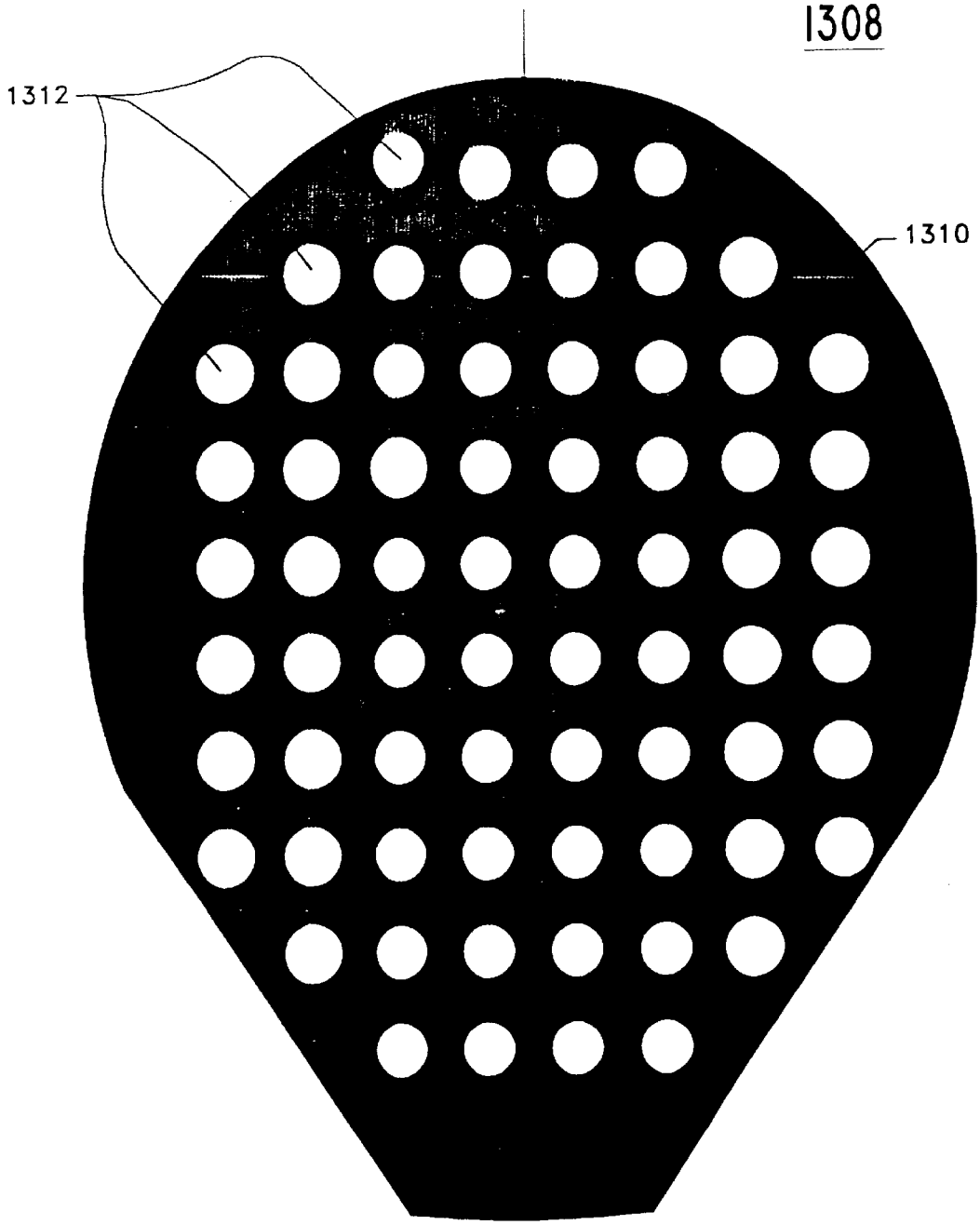
FIG. 13B is an alternative embodiment of the forming grid.

FIG. 13B shows an alternative embodiment of a forming grid 1308. In this embodiment, the forming grid 1308 comprises a filled-in matrix 1310 of cells that is basically oval or tear-drop in shape and the holes 1312 of the filled-in matrix 1310 are circles. This embodiment further dampens the vibration of the tubing 502, 504 of the head surface 104 due to the thickness of the matrix walls. It should be noted that the shape of the matrix 1302, 1310 in either embodiment is for convenience only. It would be readily apparent to one of ordinary skill to trim the corners of a forming grid 1300, 1308 to accommodate the curvature of the head portion 102 of the bat 100, or to use a different shape to achieve a different result.

For example, a forming grid 1300 may be a rectangular-shaped matrix of cells that border (or outline) the prime contract area (or "sweet spots") of a head surface 104 of a bat 100. This embodiment is called a framing forming grid. In addition, it would be readily apparent to one of ordinary skill in the relevant art(s) to design and use a forming grid 1300, or framing forming grid, with a perimeter having a different shape, such as H-shaped, O-shaped, oval-shaped, tear-shaped, 8-shaped, square, or I-shaped, wherein any such shape retards any separation of the intersection of a main strand 502 and a cross strand 504.

Figure 14:
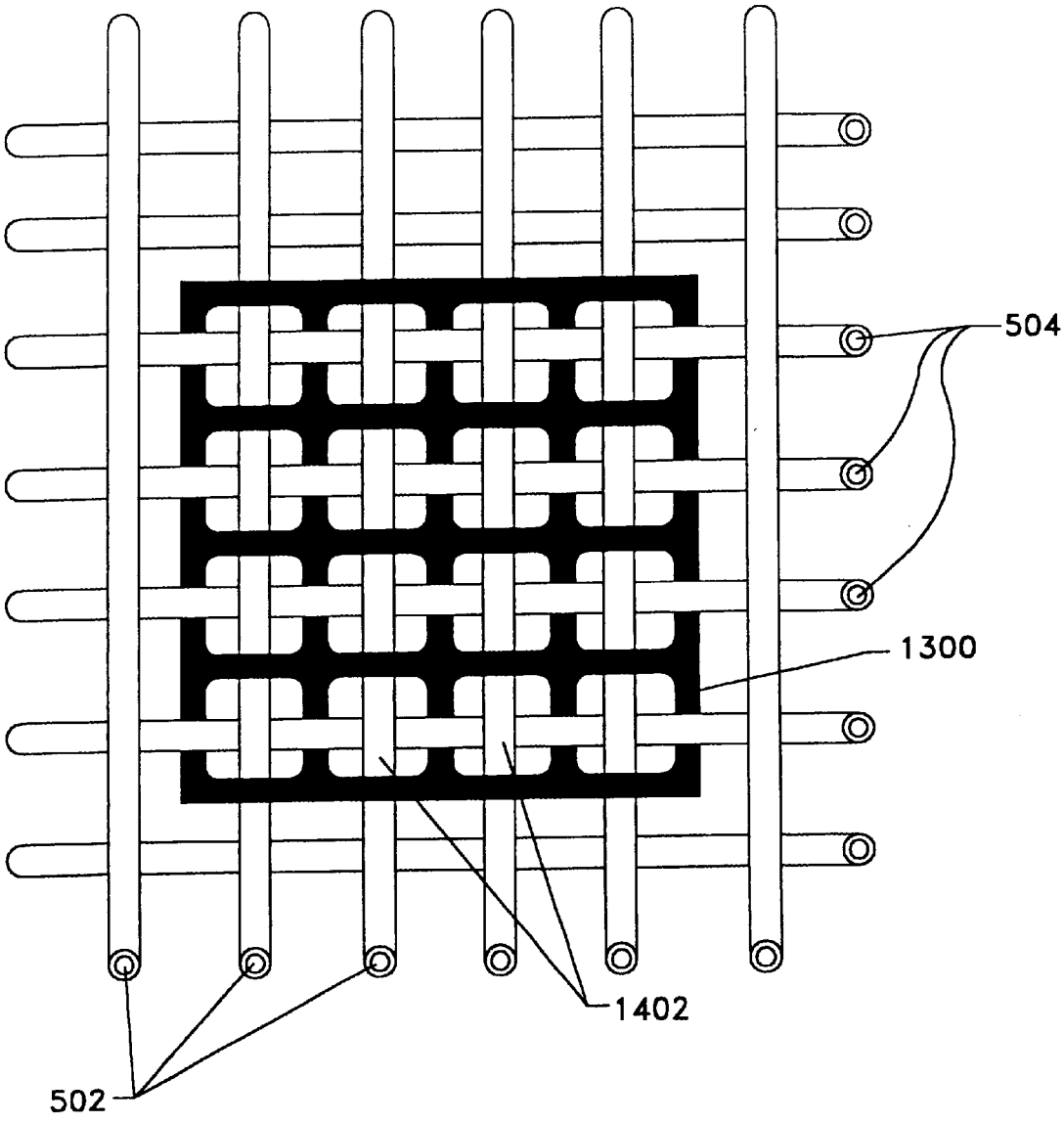
FIG. 14A is a perspective view showing the preferred embodiment for weaving elastic tubing through the forming grid.
Figure 15A:
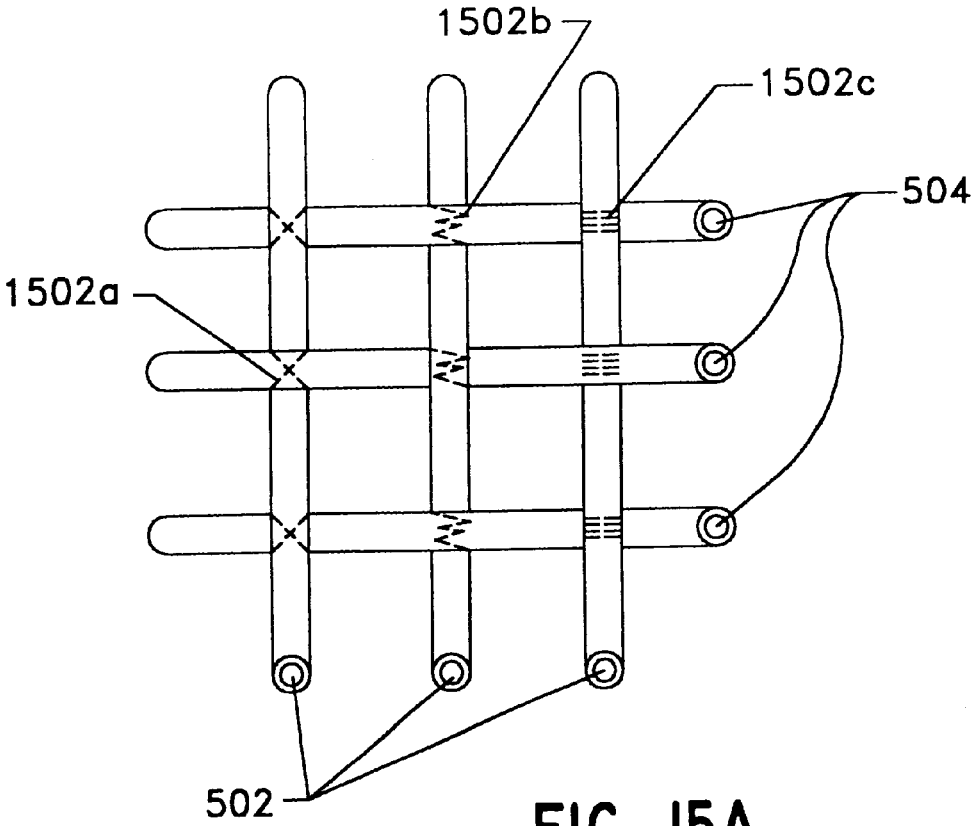
FIG. 15A is a perspective view showing the securing of an intersection of strands with stiching.
Figure 15B:
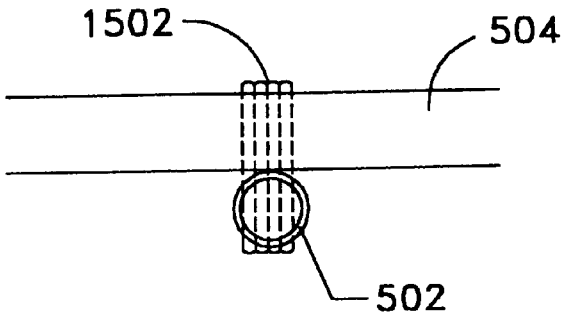
FIG. 15B is a cross sectional view showing the stitching of an intersection.
Figure 16:
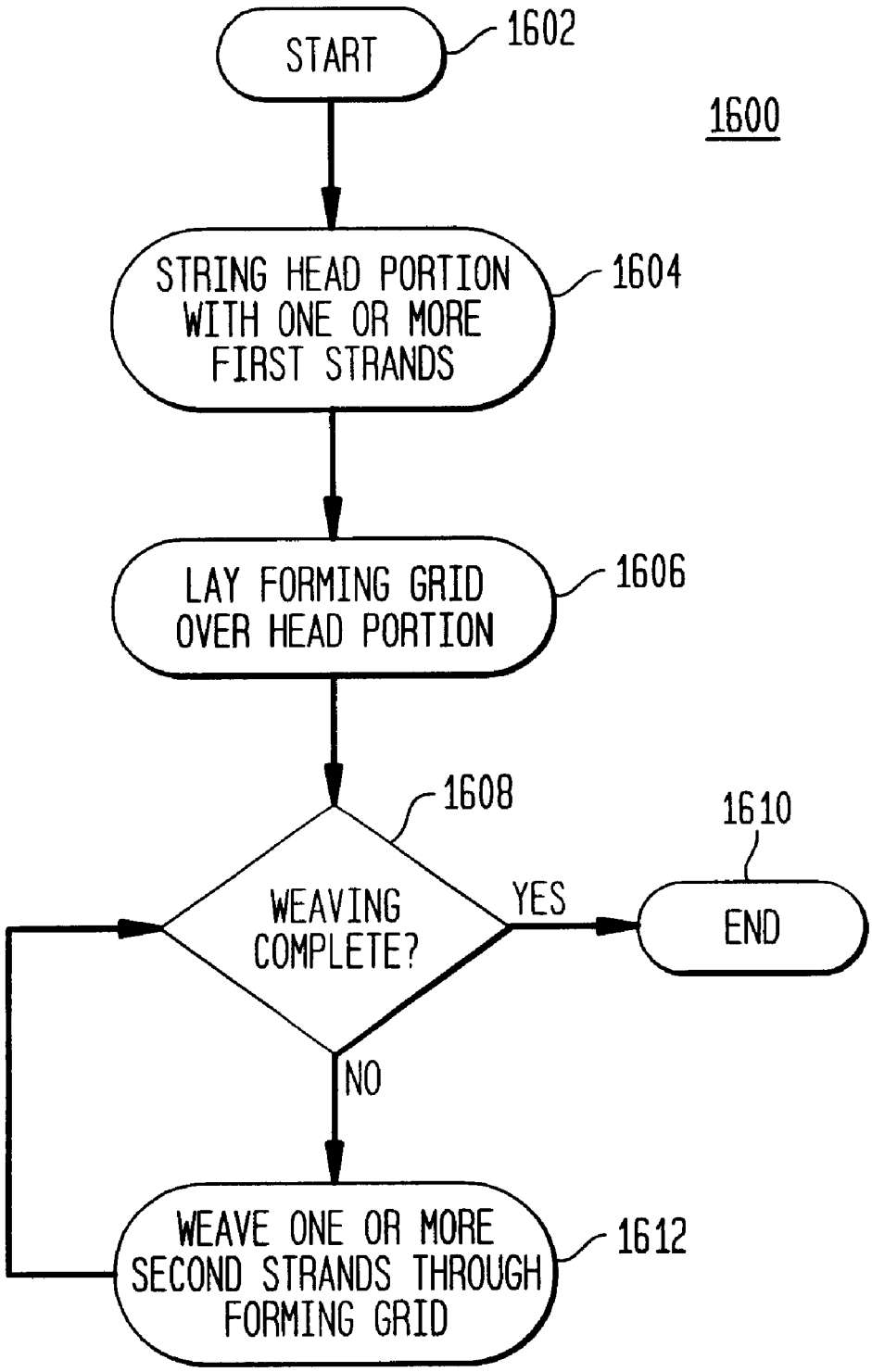
FIG. 16 is a simplified process flow diagram showing a method of using a forming grid with a fielding practice bat.

FIG. 14 illustrates the use of a forming grid 1300 showing the preferred embodiment of weaving main strands 502 and cross strands 504 through the forming grid 1300. When threading the frame 108, the main strands 502 and the cross strands 504 are woven through the forming grid 1300, thereby locking the forming grid 1300 to the head surface 104 of the bat 100. When a user hits a ball, an intersection 1402 of a main strand 502 and a cross strand 504 will not separate and vibration will be dampened—improving performance.

As discussed above, the main strands 502 and the cross strands 504 may be threaded in any desired pattern. In the preferred embodiment, as shown in FIG. 14, the main strands 502 are all positioned on the same side of the cross strands 504, and the cross strands 504 are all positioned on the same side of the main strands 502. In FIG. 14, the head surface 104 is shown as all the main strands 502 being on top of all the cross strands 504. However, this pattern of weaving is for convenience purpose only. It would be readily apparent for one of ordinary skill in the relevant art to use a different weaving pattern. For example, the main strands 502 and cross strands 504 may be threaded in a conventional over-under pattern, or the main strands 502 or cross strands 504 may skip one or more intersections between weaves. It would be readily apparent to one of ordinary skill in the relevant arts that other means or patterns of threading the elastic tubing through the forming grid 1300 may be achieved without departing from the scope of this invention.

It is important to note that the foregoing description provides the preferred embodiment of a fielding practice bat for baseball. However, several different embodiments may be made of the present invention. For example, an alternative embodiment of the bat 100 may be a junior bat, which is simply a scaled-down version of the bat 100. Likewise, a softball embodiment of the bat 100 may be made wherein the softball embodiment is shorter and wider, the preferred embodiment having a head width 106 of eleven (11) inches and an overall length 112 of twenty-nine (29) inches. This reduction in length 112 causes the bat to have a shorter throat area and a prime contact area that is lowered by approximately two and a quarter (2¼) inches. Second, the holes 202 in the preferred softball embodiment are one (1) inch apart on center. Third, for the preferred softball embodiment, each cell of a softball forming grid has outer dimensions of 1.25×1.25 inches and interior dimensions of 0.75×0.75 inches. The softball embodiment is also useful when the user is handicapped such that he/she requires a more stable bat 100.

In an alternative embodiment, one or more weights may be removably attached to the frame of the present invention in order to adjust the weight or balance of the fielding practice bat 100. Therefore, if a player wants to work-out or practice with a heavier bat, he/she only has to attach one or more weights to the frame of the fielding practice bat 100 until the desire weight and/or balance is achieved. At any point, the player may remove the weights and return the fielding practice bat 100 to its original condition. In one embodiment, the weights have a shallow rectangular shape that can be clipped on to the frame 108 between the first and second rims 204*a,b,* thereby being positioned within the recessed bottom 206 of the frame 108. In another embodiment, a weight may have a recessed channel horizontally positioned on each side such that when positioned within the channel of the frame 108, each recessed channel engages a rim 204*a,b* of the frame 108 thereby securing the weight to the frame 108.

The references to specific dimensions are used in the preferred embodiment of the present invention and are for convenience purposes only. It would be readily apparent to one of ordinary skill in the relevant art(s) to build a fielding practice bat of the present invention using different dimensions and achieve comparable results. Furthermore, enough detail and description is provided herein such one of ordinary skill in the relevant art(s) would be enabled to design, manufacture and use a fielding practice bat of the present invention.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A method for using a forming grid with a fielding practice bat, the fielding practice bat having a frame with a head portion and a handle portion, a plurality of first strands and a plurality of second strands within the head portion wherein one first strand intersects one second strand at an intersection, creating a head surface having a prime contact area, the method comprising the steps of:

a. stringing the head portion with one or more first strands;

b. laying a forming grid over the one or more first strands, said forming grid being a matrix of cells, having a perimeter wall defining a shape of said forming grid and interior walls defining a shape of said cells, said cells adapted for receiving one or more intersections of one or more first strands and one or more second strands of the fielding practice bat; and c. weaving one or more second strands through one or more said cells of said forming grid, thereby securing said forming grid to the head surface of the fielding practice bat.

2. The method according to claim 1, wherein all of the first strands are on the same side of the second strands.

3. The method according to claim 1, wherein the first strands and the second strands are woven in an over-under pattern.

4. The method according to claim 1, wherein said forming grid covers the prime contact area of the head surface of the fielding practice bat.

5. The method according to claim 1, wherein one said cell contains one intersection of a first strand and a second strand.

6. The method according to claim 1, wherein one said cell contains a plurality of intersections of first strands and second strands.

7. A method for using one or more forming grids with a fielding practice bat, the fielding practice bat having a frame with a head portion and a handle portion, a plurality of first strands and a plurality of second strands within the head portion wherein one first strand intersects one second strand at an intersection, creating a head surface having a prime contact area, the method comprising the steps of:

a. stringing the head portion with one or more first strands; and b. weaving one or more first strands through one or more cells of a forming grid, said forming grid being a matrix of cells, having a perimeter wall defining a shape of said forming grid and interior walls defining a shape of said cells, said cells adapted for receiving one or more intersections of one or more first strands and one or more second strands of the fielding practice bat, thereby securing said forming grid to the head surface of the fielding practice bat.

8. The method according of claim 7, further comprising the step of:

c. stringing the head portion with one or more second strands.

9. The method according to claim 8, further comprising the step of:

weaving one or more second strands through one or more said cells of said forming grid.

10. The method according to claim 9, wherein one or more second strands skip one or more said cells of said forming grid.

11. The method according to claim 8, further comprising the step of:

d. weaving one or more second strands through one or more cells of a second forming grid.

12. The method according to claim 8, wherein all of the first strands are on the same side of the second strands.

13. The method according to claim 8, wherein the first strands and the second strands are woven in an over-under pattern.

14. The method according to claim 8, wherein one said cell contains one intersection of a first strand and a second strand.

15. The method according to claim 8, wherein one said cell contains a plurality of intersections of first strands and second strands.

16. The method according to claim 7, further comprising the step of:

c. weaving one or more first strands through one or more cells of a second forming grid, thereby securing said second forming grid to the head surface of the fielding practice bat.

17. The method according to claim 7, wherein said forming grid covers the prime contact area of the head surface of the fielding practice bat.

18. The method according to claim 7, wherein one or more first strands skip one or more said cells of said forming grid.

* * * * *